US006530548B2

(12) United States Patent
Pizzirusso

(10) Patent No.: US 6,530,548 B2
(45) Date of Patent: Mar. 11, 2003

(54) TECHNIQUE FOR HANGING STRAP FROM EDGE OF FURNITURE

(76) Inventor: Angela Pizzirusso, 6 Smyrna Ave., Staten Island, NY (US) 10312-1902

( * ) Notice: Subject to any disclaimer, the term of this patent is extended or adjusted under 35 U.S.C. 154(b) by 0 days.

(21) Appl. No.: 10/061,781

(22) Filed: Feb. 1, 2002

(65) Prior Publication Data

US 2002/0190174 A1 Dec. 19, 2002

Related U.S. Application Data

(60) Provisional application No. 60/298,955, filed on Jun. 18, 2001.

(51) Int. Cl.[7] ..... F16B 45/00; B42F 13/00

(52) U.S. Cl. ..... 248/304; 248/339; 248/914; 248/915

(58) Field of Search ..... 248/339, 304, 248/301, 914, 915

(56) References Cited

U.S. PATENT DOCUMENTS 2,064,133 A * 12/1936 Von Schroeder ..... 248/214
2,291,686 A * 8/1942 Bray ..... 131/241
2,473,086 A * 7/1949 Montero ..... 248/308
2,532,255 A * 11/1950 Davis ..... 248/215
2,555,890 A * 6/1951 Korth ..... 224/28
3,321,166 A * 5/1967 Gordon ..... 248/206
3,376,006 A * 4/1968 Zezula ..... 248/227
3,860,210 A * 1/1975 Berardinelli ..... 248/308
D244,883 S * 6/1977 Rohrmuller ..... D87/2 R
4,210,302 A * 7/1980 Serkez ..... 248/308
5,074,508 A * 12/1991 Powers ..... 248/291
5,094,417 A * 3/1992 Creed ..... 248/215
D429,899 S * 8/2000 Schwartz ..... D6/327
6,327,811 B1 * 12/2001 Yamaguchi et al. ..... 43/107
6,345,796 B1 * 2/2002 Neuman ..... 248/308
D457,808 S * 5/2002 Williams ..... D8/373

* cited by examiner

*Primary Examiner*—Anita King
*Assistant Examiner*—Amy J. Sterling
(74) *Attorney, Agent, or Firm*—Walter J. Tencza, Jr.

(57) ABSTRACT

A method and apparatus are used to hang a purse from a piece of furniture, such as a table top. The apparatus comprises a base and a bracket having a first end and a second end. The base can be fixed to the first end of the bracket. The bracket can be positioned on the edge of a piece of furniture, such as a table top, so that the base sits on a top surface of the piece of furniture and a strap can be hung from the second end of the bracket. The base may have a base with a bottom surface which contacts the top surface of the table top when the bracket is positioned on the edge of the table top. The bracket may include a rim at the second end of the bracket and a portion connected to the rim, wherein the rim has a larger diameter than the portion, so that the strap placed over the portion will be prevented from falling off of the bracket.

15 Claims, 4 Drawing Sheets

TECHNIQUE FOR HANGING STRAP FROM EDGE OF FURNITURE

CROSS REFERENCE TO RELATED APPLICATION—CLAIM FOR PRIORITY BASED ON PROVISIONAL

This application hereby claims the priority of a provisional patent application Ser. No. 60/298,955, filed on Jun. 18, 2001, titled "Purse Mate", inventor and applicant Angela Pizzirusso, which is the same inventor and applicant for this current non-provisional application.

FIELD OF THE INVENTION

This invention relates to improved methods and apparatus concerning placing purses and other objects in a safe location.

BACKGROUND OF THE INVENTION

Typically in the prior art an individual with a purse will place that purse on a floor when the individual sits down. However, this may result in the purse being stepped on or knocked over. In addition if the floor is not clean, this may result in the purse becoming dirty.

SUMMARY OF THE INVENTION

The present invention provides a method and apparatus for hanging a purse from a piece of furniture such as a table top. In one embodiment an apparatus comprising a base and a bracket having a first end and a second end is provided. The base can be fixed to the first end of the bracket. The bracket can be positioned on the edge of a piece of furniture, such as a table top, so that the base sits on a top surface of the piece of furniture and a strap can be hung from the second end of the bracket. The base can be a three dimensional substantially solid object, which can be made of metal.

The base can be attached to the first end of the bracket by attaching a threaded end of the first end of the bracket to a nut having internal threads or some other device for removably attaching and detaching the base from the first end of the bracket. The base may be an ornamental object which can be replaced by removing the nut from the first end of the bracket, placing a different base or ornamental object on the first end of the bracket and then screwing the nut back onto the first end of the bracket. The base may have a bore or cylindrical hole which is at an angle with respect to a bottom flat surface of the base. The first end of the bracket can be inserted into the bore and then the nut can be screwed on the first end of the bracket to secure the base to the bracket.

The base may have a bottom portion with a bottom flat surface which contacts the top surface of the table top when the bracket is positioned on the edge of the table top. The bracket may include a rim at the second end of the bracket and a second end portion connected to the rim, wherein the rim has a larger diameter than the second end portion, so that the strap placed over the second end portion of the bracket will be prevented from falling off of the bracket.

The bracket may have a width between its first end and its second end which is adapted to be greater than a thickness of an edge of the table top. The bracket may be comprised of metal. The base may be comprised of an ornamental design.

The present invention may also include a method comprising the steps of placing an apparatus comprised of a base fixed to a first end of a bracket on an edge of a table top, so that the base sits on a top surface of the table top; and hanging a strap from a second end of the bracket. The strap may be connected to a bag portion of a purse.

DETAILED DESCRIPTION OF THE DRAWINGS

Figure 1:
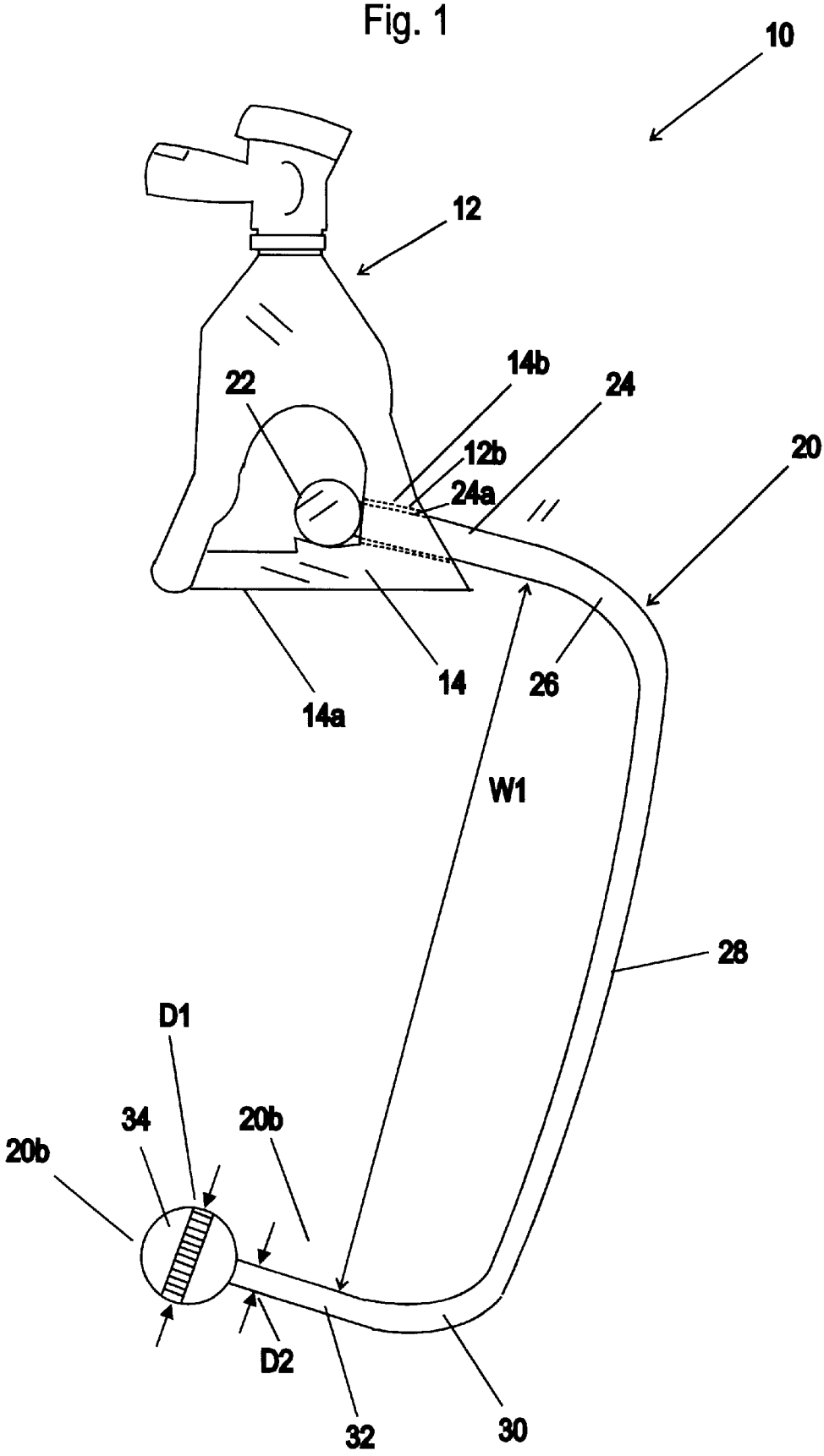
FIG. 1 shows a side view of an apparatus in accordance with an embodiment of the present invention.

FIG. 1 shows a side view of an apparatus 10 in accordance with an embodiment of the present invention. The apparatus 10 includes a base 12 and a bracket 20.

The base 12 in FIG. 1 has the ornamental design of a dog, however, any type of base can be used whether in the form of an ornamental design or without any ornamental design. The base 12 has a bottom portion 14 with a bottom flat surface 14*a*. The bottom 14 is fixed at point 14*b* to the bracket 20. The base 12 has a cylindrical hole or bore 12*b* which is inclined upwards at an angle with respect to the flat surface 14*a*. This inclined bore 12*b* helps to prevent a purse falling off of a table top or other piece of furniture as shown by FIG. 2.

Figure 4:
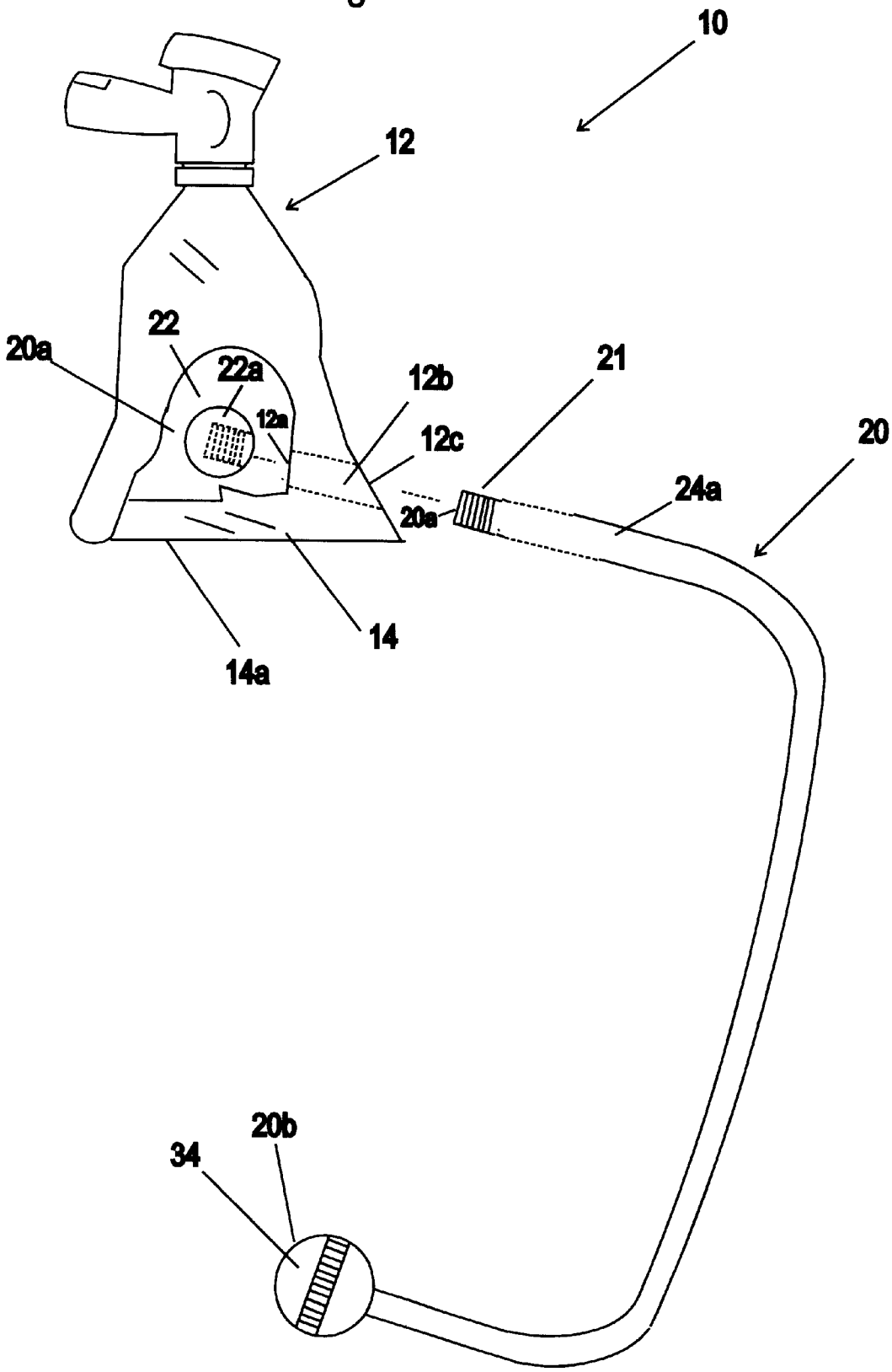
FIG. 4 shows a side view of the apparatus of FIG. 1, which includes a bracket and a base, with the bracket separated from the base piece.

The bracket 20 has a first end 20*a* and a second end 20*b*, as shown in FIG. 4. The bracket 20 has attached to it a nut or ball portion 22. The ball portion 22 can be considered to be part of the bracket 20 or a separate element. The bracket 20 includes a substantially straight portion 24, curved portions 26, 28, and 30, a substantially straight portion 32, and a rim portion 34. The bracket 20 has an inner width, W1, which may be about 3.75 inches. The rim portion 34 may have a diameter of D1, which may be about 0.25 inches. The diameter, D1, should be greater than the diameter D2 of the portion 32, which may be 0.125 inches. The portions 24, 26, 28, and 30 may also have a diameter of 0.125 inches. The ball portion 22 may be slightly smaller than the rim portion 34 but slightly larger than the diameter D2 and may have a diameter of 0.1875 inches.

The base 12 is, one embodiment, removably attached to the portion 24 of the bracket 20 by screwing on the ball portion or nut 22 onto threads 21 of the bracket 20. This allows for different bases or ornaments to replace the base 12. However, the base 12 may alternatively be fixed to the portion 24 of the bracket 20 by welding or in any other known manner and/or the base 12 may be formed integrally with the bracket 20.

Figure 2:
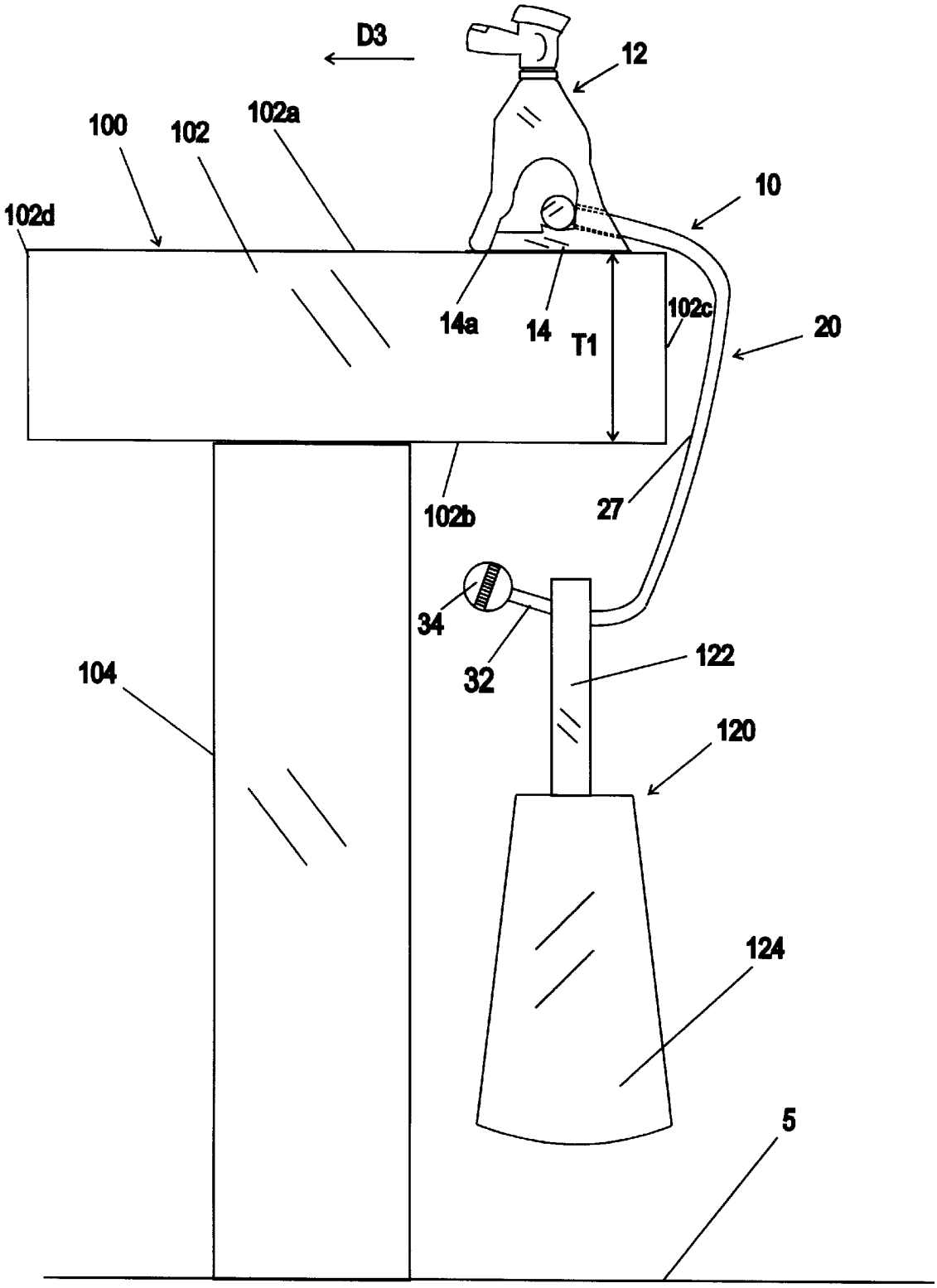
FIG. 2 shows a side view of the apparatus of FIG. 1 with the apparatus attached to a table top and with a purse held by the apparatus.
Figure 3:
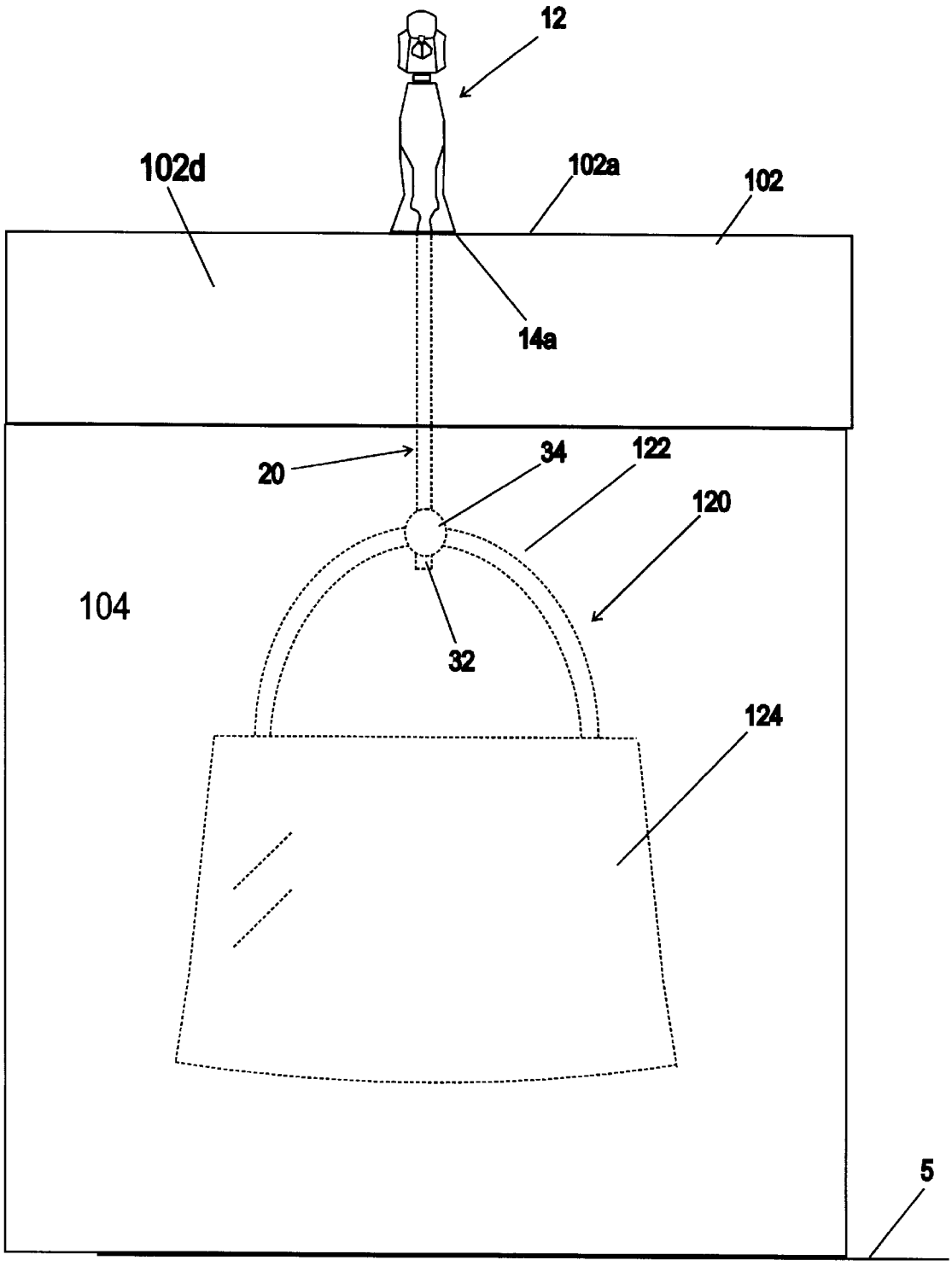
FIG. 3 shows a front view of part of the apparatus of FIG. 1 in solid lines, with part of the apparatus that is hidden by the table of FIG. 2 in dashed lines and a front view of the purse that is hidden by the table in dashed lines.

FIG. 2 shows a side view of the apparatus 10 of FIG. 1 with the apparatus 10 attached to a table top 102 and with a purse 120 held by the apparatus 10. The table top 102 is part of a table 100 which may include base or support 104. The table top 102 may have an edge 102*c* which has a thickness T1, which may be, for example, two inches. The thickness T1, of the table top 102 would be less than the width W1 of the bracket 20. The table 100 may include further support, not shown. The purse 120 may include a strap 122 and a bag portion 124. The table top 102 also has a top surface 102*a* and a bottom surface 102*b*. FIG. 3 shows a front view of part of the apparatus 10 of FIG. 1 in solid lines, a front view of part of the apparatus 10 which is hidden by the table 100 in dashed lines and a front view of the purse 120 which is hidden by the table 100 in dashed lines. In accordance with an embodiment of the present invention, only the base 12 can be seen by an individual sitting near end 102*d* of the table opposite edge 102*c* of the table where the apparatus 10 and purse 120 are located. As shown by FIGS. 2 and 3, except for the base 12, the apparatus 10 and the purse 120 is hidden by the table 100.

FIG. 4 shows a side view of the apparatus 10 of FIG. 1, with the bracket 20 separated from the base 12. The bracket 20 has threads 21 at the first end 20*a*. The nut or ball portion 22 has internal threads 22*a*. The portion 24*a* can be inserted through the bore or cylindrical hole 12*b* at opening 12*c* of the base 12 so that the threads 21 come out opening 12*a*. The threads 21 can then be inserted into the internal threads 22*a* to attach the base 12 to the bracket 20 as shown by FIGS. 1 and 4.

In operation, an individual would take the apparatus 10 and place it in the position shown in FIG. 2. In the position of FIG. 2, the bottom surface 14*a* of the base 12 contacts the top surface 102*a* of the table top 102. The bottom surface 14*a* may be rectangular or any other shape. The base 12 may be a three dimensional substantially solid ornamental object made of metal. The base 12 is fixed to the bracket 20 and thus effectively holds the bracket 20 in a set position relative to the table 100 and table top 102. The base 12 can be pushed further in the direction D3, shown in FIG. 2, until the edge 102*c* of the table top 102 touches the inner surface 27 of the bracket 20.

After the apparatus 10 has been placed in the position shown in FIG. 2, the purse 120 can be attached or hung on the bracket 20, as also shown in FIG. 2 and in FIG. 3. The purse 120 can be hung from the bracket 20, by placing the strap 122 over the portion 32. The bag 124 hangs from the strap 122 and is thus elevated from and not in contact with the floor 5, as shown in FIG. 2. The strap 122 and thus the purse 120, is kept from falling off of the portion 32 by the rim 34 and by the inclined bracket 20 due to the inclined cylindrical bore 12*b* of base 12.

The bottom surface 14*a* may be made of cloth or some other non abrasive material, so that the bottom surface 14*a* will not scratch or otherwise damage the top surface 102*a* of the table top 102.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first base; and a C-shaped bracket having a first end and a second end;

wherein the first base is attached to the first end of the C-shaped bracket;

and wherein the C-shaped bracket can be positioned on the edge of a piece of furniture so that the first base sits on a top surface of the piece of furniture and a strap can be hung from the second end of the C-shaped bracket;

and further comprising a device for removably attaching and detaching the first base from the first end of the C-shaped bracket; and wherein the device for removably attaching and detaching the first base from the first end of the C-shaped bracket includes a nut having inner threads, wherein the first end of the C-shaped bracket is inserted into the nut to attach the C-shaped bracket to the first base.

2. The apparatus of claim 1 wherein the piece of furniture is a table top.

3. The apparatus of claim 2 wherein the first base has a bottom surface which contacts the top surface of the table top when the C-shaped bracket is positioned on the edge of the table top.

4. The apparatus of claim 1 wherein the C-shaped bracket includes a rim at the second end of the C-shaped bracket and a portion connected to the rim;

and wherein the rim has a larger diameter than the portion, so that the strap placed over the portion will be prevented from falling off of the C-shaped bracket.

5. The apparatus of claim 2 wherein the C-shaped bracket has a width between the first end of the C-shaped bracket and the second end of the C-shaped bracket which is adapted to be greater than a thickness of an edge of the table top.

6. The apparatus of claim 1 wherein the C-shaped bracket is comprised of metal.

7. The apparatus of claim 1 wherein the first base is comprised of a first ornamental design.

8. The apparatus of claim 1 wherein the first base is attached to the first end of the C-shaped bracket so that a portion of the C-shaped bracket is inclined with respect to a bottom surface of the first base.

9. The apparatus of claim 8 wherein the first base has an inclined bore, which is inclined with respect to the bottom surface of the first base, into which the first end of the C-shaped bracket is inserted to attach the first base to the C-shaped bracket.

10. The apparatus of claim 1 wherein the nut is in the shape of a ball.

11. The apparatus of claim 1 further comprising a second base which differs in appearance from the first base;

wherein the second base can be attached to the first end of the C-shaped bracket;

and wherein the second base is removably attached and detached from the first end of the C-shaped bracket by the device for removably attaching and detaching the first base from the first k end of the C-shaped bracket.

12. A method comprising the steps of:

attaching a first base to a first end of a bracket to form a first apparatus, wherein the first apparatus can be placed on an edge of a piece of furniture so that the first base sits on a top surface of the piece of furniture;

detaching the first base from the first end of the bracket; and attaching a second base, which is different in appearance from the first base, to the first end of the bracket to form a second apparatus, wherein the second apparatus can be placed on the edge of the piece of furniture so that the second base sits on the top surface of the piece of furniture;

wherein the piece of furniture is a table top;

wherein the first base has a bottom surface which contacts the top surface of the table top when the first apparatus is placed on the edge of the table top and the second base has a bottom surface which contacts the top surface of the table top when the second apparatus is placed on the edge of the table top;

wherein the bracket includes a rim at the second end of the bracket and a portion connected to the rim;

and wherein the rim has a larger diameter than the portion, so that the strap placed over the portion will be prevented from falling off of the bracket.

13. The method of claim 12 wherein the bracket has a width between its first end and its second end which is adapted to be greater than a thickness of an edge of the table top.

14. The method of claim 12 wherein the bracket is comprised of metal.

15. An apparatus comprising a first base a second base which differs in appearance from the first base; and a C-shaped bracket having a first end and a second end; and wherein the first base can be attached to the first end of the C-shaped bracket to form a first device, wherein the first device can be placed on an edge of a piece of furniture so that the first base sits on a top surface of the piece of furniture, and a strap can be hung from the second end of the C-shaped bracket;

wherein the first base can be detached from the first end of the C-shaped bracket;

wherein the second base can be attached to a first end of the C-shaped bracket to form a second device, wherein the second device can be placed on the edge of the piece of furniture so that the second base sits on the top surface of the piece of furniture; and wherein the second base can be detached from the first end of the C-shaped bracket.

* * * * *